United States Patent [19]

Brown

[11] Patent Number: 4,520,954

[45] Date of Patent: Jun. 4, 1985

[54] COUPLER

[75] Inventor: Anthony D. Brown, Woodland Hills, Calif.

[73] Assignee: Grundy Dispense Systems, Inc., Canoga Park, Calif.

[21] Appl. No.: 373,963

[22] Filed: May 3, 1982

[51] Int. Cl.[3] ..... B67D 1/04

[52] U.S. Cl. ..... 222/400.8; 222/400.7; 222/542; 137/212; 137/322

[58] Field of Search ..... 222/400.7, 400.8, 402.25, 222/542; 277/212 FB; 137/322, 320, 317, 212; 251/149.5–149.7; 285/45, 9 R; 141/346, 392, 370, 388

[56] References Cited

U.S. PATENT DOCUMENTS

| | | | |
|---|---|---|---|
| 220,679 | 10/1879 | Stephan | 137/317 |
| 2,553,447 | 5/1951 | Fechheimer | 141/392 |
| 3,430,995 | 3/1969 | Herbenar et al. | 277/212 FB X |
| 3,473,556 | 10/1969 | Johnson et al. | 222/400.7 X |

FOREIGN PATENT DOCUMENTS

| | | | |
|---|---|---|---|
| 2456741 | 6/1975 | Fed. Rep. of Germany | 137/320 |
| 869455 | 5/1961 | United Kingdom | 285/9 R |
| 958111 | 5/1963 | United Kingdom | 222/400.7 |

*Primary Examiner*—Charles A. Marmor

*Attorney, Agent, or Firm*—Thomas I. Rozsa

[57] ABSTRACT

An improved mechanical coupler which is utilized in systems for tapping kegs of fluids which are kept under pressure. The improvement consists of a probe head which is fixed relative to the probe of the coupler and a large flexible fluid seal which is designed in three sections such that the two uppermost sections enable the seal to fold in on itself while the lowermost section lies substantially flat against the valve assembly to thereby form a very secure sealing means between the probe and the valve assembly of the container when the seal is compressed against the valve assembly at the time the improved coupler is locked in place.

4 Claims, 6 Drawing Figures

Fig. 3.
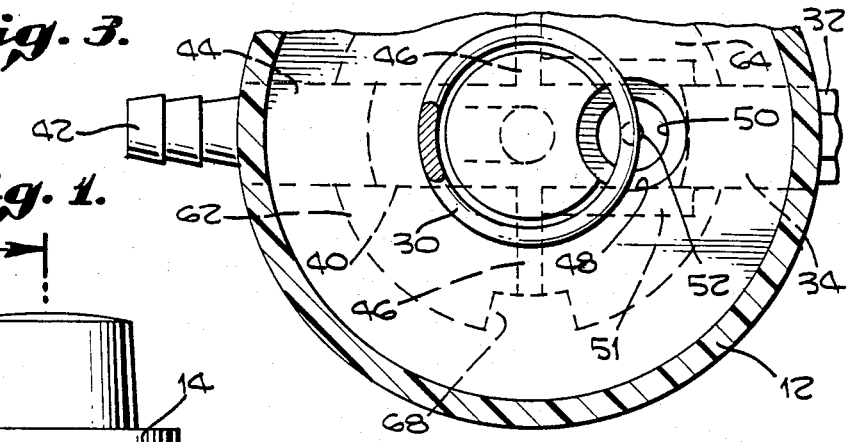
Fig. 1.
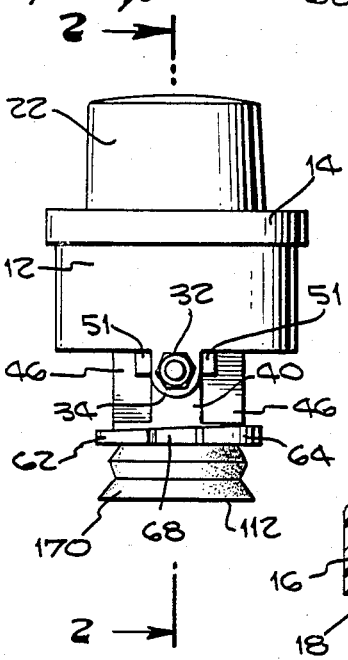
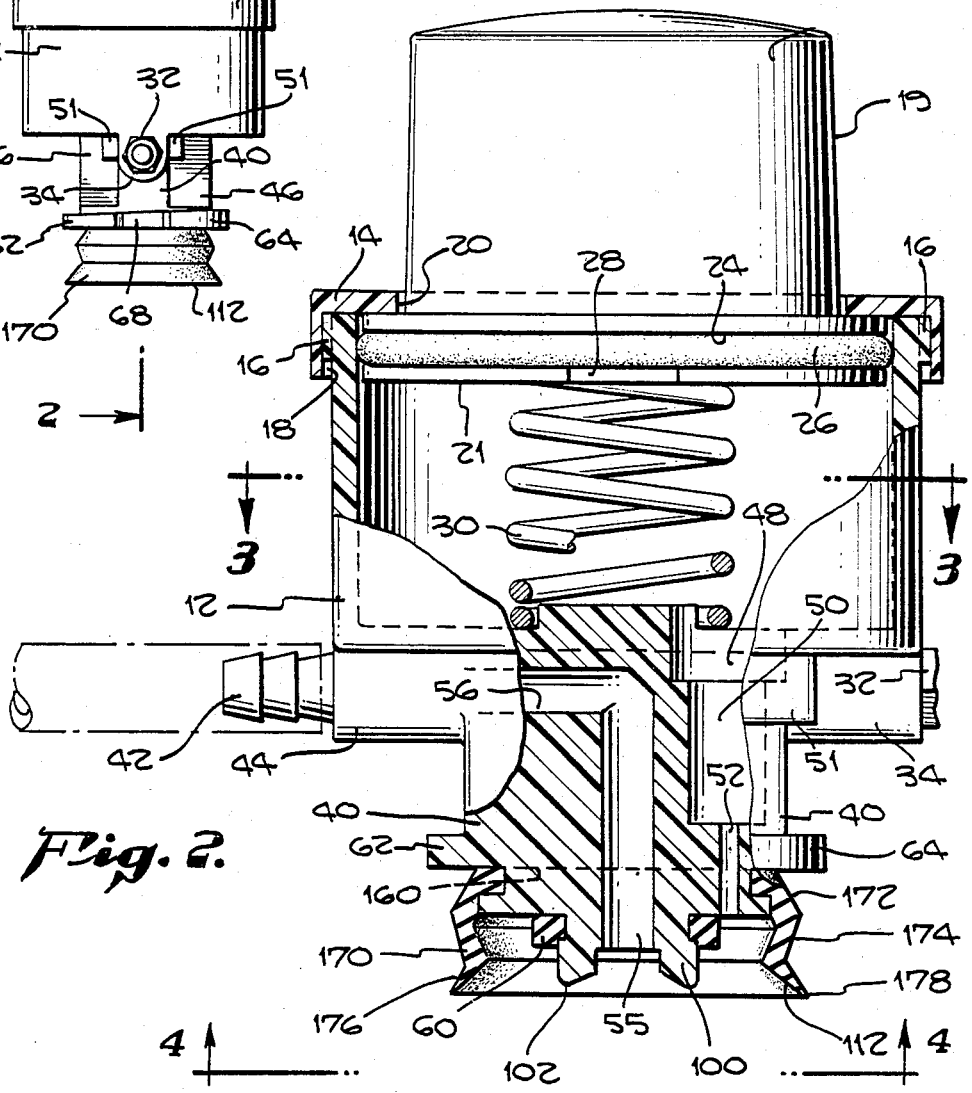
Fig. 2.

COUPLER

BACKGROUND OF THE INVENTION

The present invention relates to an improved coupling device which is utilized for tapping kegs of fluids which are kept under pressure. This improved coupling device is particularly applicable for tapping a keg of beer.

In operation, the coupler is inserted by depression and rotation into a valve assembly which is located at the opening of the container of fluid such as beer. Valve assemblies for this purpose have been in commercial use for many years. One such valve assembly is described in U.S. Pat. No. 4,181,143 issued to Fallon. The valve assembly comprises a ball valve which is forced against its seat by spring pressure. When a counteracting force pushes the ball valve off its seat, the fluid under pressure is permitted to escape through the opening between the ball valve and its seat.

The function of the coupler is to create an inlet for a pressurizing gas and an exit apparatus by which the fluid can be removed from the container and poured into a glass or cup. Two general types of couplers are presently in use; a commercial coupler which is designed to accomodate a source of counter pressure such as $CO_2$ and a consumer coupler which generates its counter pressure through air which is compressed by means of a piston. The consumer coupler in this mode is commonly known as a picnic pump system.

In a conventional commercial coupler, such as that described in U.S. Pat. No. 4,181,143 issued to Fallon, the coupler is inserted by rotation into the valve assembly. The coupler contains cams at its lower face and they are accommodated by lugs which are on the inner circumference of the container opening adjacent the valve assembly. Then, by a separate action, a handle or cam actuates a movable probe inside the coupler which pushes against the ball valve assembly and thereby permits the flow of fluid into and out of the container through appropriate channels. The probe which forces the ball valve away from its seat moves relative to its surrounding cam which secures the coupler to the container. In order to achieve this, an expensive actuating system is necessary.

In the conventional picnic pump system, once again the coupler is inserted by rotation into the valve assembly. This consumer coupler also contains cams at its lower face and they are accommodated by lugs which are on the inner circumference of the container opening adjacent the valve assembly. After the consumer coupler is secured to the container, a second rotating action causes a movable probe to further rotate downward relative to the locked cams and push the ball valve off its seat to thereby permit the flow of fluid into and out of the container through appropriate channels. Once again, having the probe move relative to the cam is an expensive product to manufacture and if the probe is accidentally lowered before the cam is locked in place, the pressurized fluid will spew out of the canister. Having the probe move relative to its surrounding cams also subjects the apparatus to more leakage of fluid in this area. The pressure from this consumer coupler is generated by a piston at the top, which compresses air and forces it into the container when the piston is forced downward. The presently used consumer couplers are made in several pieces which are attached together by a tongue and groove assembly and other similar mechanisms. This multipiece construction adds cost to the product.

Therefore, the prior art has couplers wherein the valve opening probe moves relative to the cams which secure the coupler to the valve housing or container opening. The actuation of the probe requires a second rotational movement or lever action after the coupler has been secured to the container. This movable probe assembly has many disadvantages. First, it is expensive to produce. Second, if the movable probe is in its down position before the coupler is firmly secured to the container, the fluid under pressure inside the container may spew out. Third, it is possible for leaks to occur at the side of the gap between the movable probe and its surrounding support structure.

The couplers discussed in the prior art are also made of multiple piece construction. This further increases the cost of manufacture and assembly of the units.

SUMMARY OF THE PRESENT INVENTION

A standard coupling device which is used to dispense fluid under pressure from a container has, among its elements, a probe which is placed into the valve assembly of the container. The forward central portion of the probe also contains a probe head which is used to open the valve assembly of the container and permit the fluid to exit therefrom.

It has been discovered, according to the present invention, that if a large flexible fluid seal is placed on the outermost circumference of the forward end of the probe and is designed so that it is capable of folding in on itself and expanding, it thereby forms a very secure sealing means at the interface of the probe and the valve assembly when the seal is compressed against the valve assembly. This secure seal will eliminate the possibility of leakage of fluid or pressurized gas.

It has further been discovered, according to the present invention, that if the probe head is fixed and integral with the probe, the ease of placing the coupler into the valve assembly is vastly simplified. The use of a fixed probe head eliminates a significant amount of mechanical actuating mechanisms to raise and lower the probe head. The fixed probe head also significantly reduces the cost of manufacture and assembly of the finished coupler.

It has additionally been discovered, according to the present invention, that if the height of the large flexible fluid seal on the circumference of the forward end of the probe is great enough so that the seal will come in contact with the valve housing of the valve assembly before the fixed probe head comes in contact with the movable portion of the valve, a fixed probe may be used with the coupling device because the seal will prevent any fluid from spewing out of the container after the probe head causes the valve assembly to open. If the height of the large flexible fluid seal is not this great, only a movable retractable probe head can be used in order to avoid the possibility of fluid under pressure spewing out from the container. The use of a seal of this design permits the utilization of a fixed or stationary probe head which has the advantages described above.

A consumer coupler which is also known as a picnic pump does not require an external pressure source since it compresses air by means of a piston. It has also been discovered, according to the present invention, that if the main cylinder body and the probe of the coupling device are made of one piece construction, the cost of the production and assembly of the unit is significantly reduced. This one piece construction also reduces the likelihood of mechanical failures.

It is therefore an object of the present invention to provide an Improved Coupler for dispensing fluid under pressure from a container.

It is another object of the present invention to provide an improved sealing means between the probe and of the coupler and the valve assembly of the container, to assure that gas or fluid will not have any possibility of leaking out of the valve or the probe when in use.

It is a further object of the present invention to provide an improved coupler which has a fixed probe head instead of a movable probe head to thereby increase the ease and efficiency with which the coupler is inserted into the valve assembly of the container and to further eliminate costly mechanical actuating mechanisms to raise and lower the probe head.

It is still another object of the present invention to provide a design for the large flexible fluid seal around the circumference of the probe which will permit the probe to use a fixed probe head instead of a movable probe head which must be retracted before the probe can be inserted into the valve assembly.

It is still a further object of the present invention to provide a one piece design for a consumer used coupler to therefore reduce the cost of manufacture and assembly of the unit.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation there is illustrated:

FIG. 1 is a side view of the Improved Coupler.

FIG. 2 is a side-sectional view taken along line 2—2 of FIG. 1.

FIG. 3 is a cross-sectional view taken along line 3—3 of FIG. 2.

DETAILED DESCRIPTION OF THE PREFERRED EMBODIMENT

Figure 4:
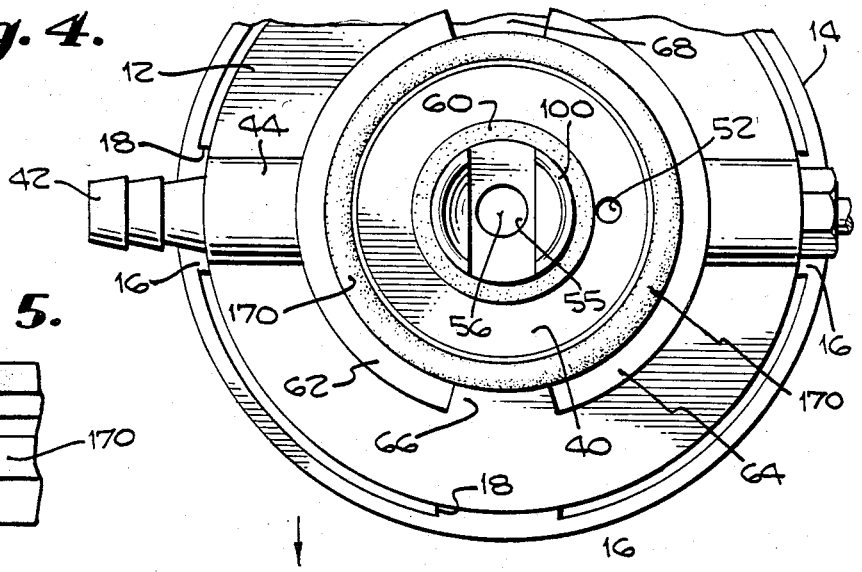
FIG. 4 is a bottom plan view taken along line 4—4 of FIG. 2.

With reference to the drawings of the invention in detail and more particularly to FIG. 1, there is shown at 10 the preferred embodiment of the Improved Coupler. As shown in FIG. 1, the present invention comprises a main cylinder body 12 which removably receives a cylinder cap 14. Referring to the side-sectional view of FIG. 2, it can be seen that the upper portion of the main cylinder body 12 contains a multiplicity of splines 16 which receive corresponding grooves 18 in the cylinder cap 14. The purpose of the spline 16 and groove 18 arrangement is to enable the main cylinder body 12 to rigidly retain the cylinder cap 14 and to prevent rotation of the cylinder cap 14 relative to the main cylinder body 12.

Figure 6:
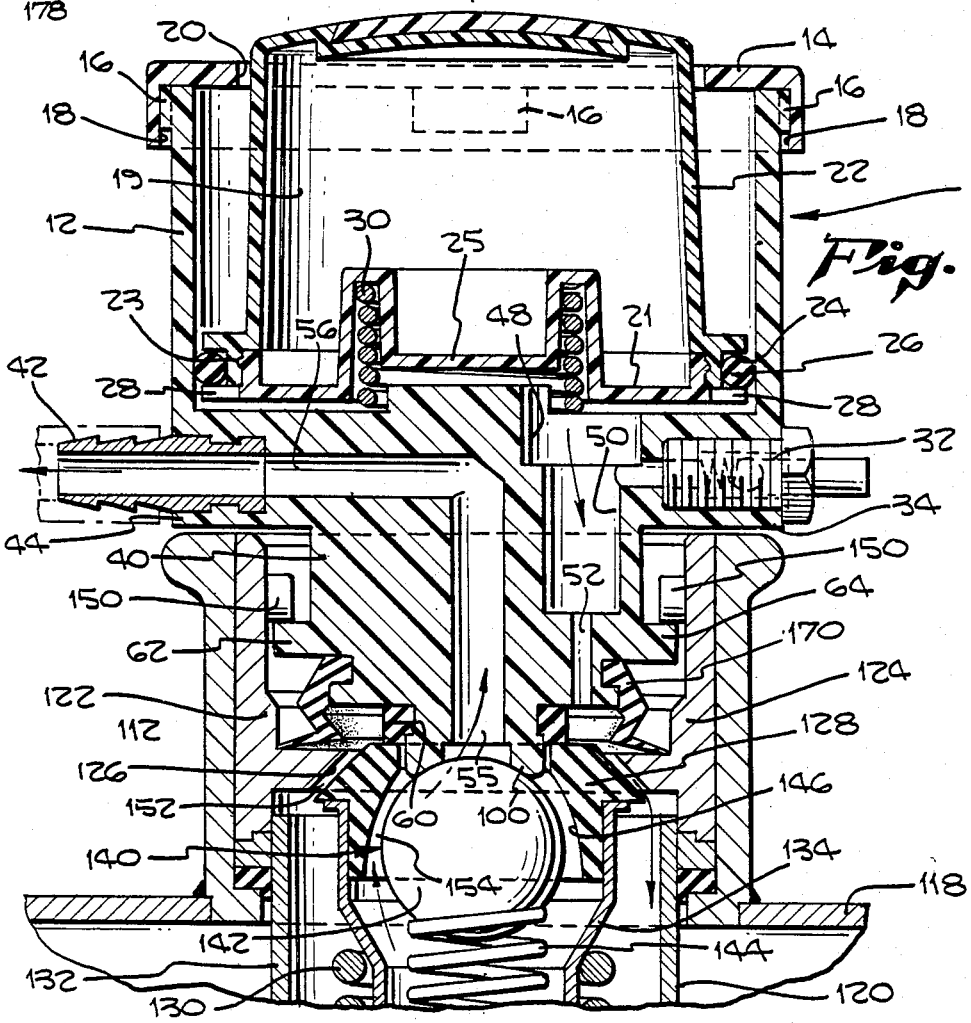
FIG. 6 is a side-sectional view of the Improved Coupler after it has been inserted into the valve assembly of a container and the piston at the top of the Improved Coupler has been depressed.

Referring to FIG. 2, the cylinder cap 14 contains an opening 20 which receives a movable piston 22. As illustrated in FIG. 6, this piston 22 contains an upper body 19 and a lower body 21 which are interconnected by a tongue and groove assembly 22. Piston 22 contains groove 24 at its lower portion. Groove 24 receives O-Ring 26. Piston 22 also contains a multiplicity of slots 28. The piston 22 is retained in its upward position by spring 30 inside the main cylinder body 12. As shown in FIG. 6, the lower piston body 21 has a male member 25 which is located in the center of the spring 30. This male member removes an air pocket in the center of the spring 30 and this increases the efficiency of the piston 22.

Extending from the main cylinder body 12 and integral therewith is a fixed probe 40. At the forward end of the probe 40 is a probe head 100. One of the unique features of the present invention is the fact that the probe head 100 is stationary or fixed relative to the probe 40 and the main cylinder body 12. The probe head 100 is also an integral unit with probe 40 and main cylinder body 12. This is important because it reduces the cost of manufacture and assembly of the unit, and reduces the complex actuating system which accompanies a movable probe head.

As shown in FIG. 1 and FIG. 2, the upper portion of the probe 40 contains a relief valve 32 which is surrounded by a boss 34. The relief valve 32 and boss 34 extend transversely to the longitudinal axis of the main cylinder body 12 and the relief valve 32 protrudes past the outer wall of the main cylinder body 12. As shown in FIG. 2, the upper portion of the probe 40 also contains a fluid dispensing outlet 42 which is surrounded by a boss 44. The fluid dispensing outlet 42 is located opposite the relief valve 32 and it also protrudes past the outer wall of main cylinder body 12.

The probe 40 also contains a multiplicity of support webs 46 located along its length. The support webs 46 provide strength to the probe 40. One side of the probe 40 contains three interconnected bores, each having a different diameter. The widest bore 48 is uppermost along the length of the probe 40, followed by second bore 50 which has a smaller diameter. Bore 50 is followed by third bore 52 which has the smallest diameter. Bores 48 and 50 accommodate a check valve (not shown). As shown in FIG. 3, a shoulder 51 is located on either side of the web through which the bores are placed. The shoulder 51 provides additional support for the check valve.

Referring to FIG. 2 and FIG. 4, the forward or lowermost face of the probe 40 contains the fixed probe head 100. The probe head 100 surrounds the opening of primary fluid bore 56 which is a pipe that is molded into the probe 40. At its other end, the primary fluid bore 56 is connected to fluid dispensing outlet 42. Surrounding the probe head 100 but elevated from its forward tip 102 is a small fluid seal 60. Surrounding the small fluid seal 60 are mating cams 62 and 64 which have slots 66 and 68 separating them.

On the outermost circumference of the forward end of the probe 40 is a large flexible fluid seal 170. The tip of the large flexible seal 170 extends beyond the tip 102 of the probe head 100. The large flexible seal 170 is shown in greater detail in the partial side-sectional view of FIG. 5. This large flexible seal 170 is another unique feature of the present invention. Its purpose is to seal the entire forward end of the probe against gas and fluid leaks. As will be discussed below, it is unique because it permits the utilization of a fixed probe head 100 on probe 40. The large flexible seal 170 also is unique in that its design, as shown in FIG. 1, FIG. 6 and the detailed view in FIG. 5, permits it to be collapsible and fold back into itself on its upper portion while at the same time fold outwardly on its lower portion. The large flexible seal 170 which is of one piece construction contains an outwardly extending upper portion 172, an inwardly extending middle portion 174, and an outwardly extending lower portion 176 which terminates in tip 178. In the area of the junction of the outwardly extending upper portion 172 and inwardly extending middle portion 174 is an inner recess 173. This unique design of large flexible seal 170 creates a bellows action which assures vastly superior sealing qualities. The height of this large flexible fluid seal 170 relative to the probe head 100 is also of great importance, as will be discussed later. As shown in FIG. 2, the height of large flexible fluid seal 170 is such that its forward tip 178 is below (or extends beyond) the forward tip 55 of the primary fluid bore 56, in probe head 100 as well as beyond tip 102 of probe head 100. As will be discussed later on, this permits the large flexible fluid seal 170 to come in contact with the appropriate value surfaces and seal off the valve before the probe head 100 opens the valve.

The present invention is shown in operation in FIG. 6. The Improved Coupler 10 is secured to the valve assembly 120 of a container of fluid 118 such that pressure may be imparted to the container through the Improved Coupler 10 and the fluid under pressure may be removed from the container through the Improved Coupler 10. The upper portion of a standard valve assembly 120 is shown in FIG. 6. The standard valve assembly 120 consists of dual valves which are first valve assembly 122 and second ball valve assembly 140, which operate concentrically with each other. The first valve assembly 122 contains a first valve housing 124 which has a first valve seat 126 at its lower interior surface. The first valve assembly 122 is normally retained in its closed position by having first valve member 128 retained against first valve seat 126. A first compression spring 130 is retained within valve body housing 132. A siphon tube 134 also runs parallel to the first compression spring 130 and its upper portion engages the lower surface of first valve member 128. The first compression spring 130 presses upward on siphon tube 134 which in turn presses against first valve member 128. This force serves to press first valve member 128 against first valve seat 126 and therefore retain first valve assembly 122 in a closed position.

The second ball valve assembly 140 contains a ball valve member 142 which is supported by second compression spring 144. The lower interior portion of first valve member 128 acts as the valve seat 146 for the second ball valve assembly 140. The top portion of second compression spring 144 presses against the lower portion of second ball valve member 142 and retains it against second valve seat 146 so that the second ball valve assembly 140 is normally in a closed position.

The upper portion of the housing for the valve assembly 120 contains receiving lugs 150. These receiving lugs 150 receive mating cams 62 and 64 of the Improved Coupler 10. The Improved Coupler 10 is designed to cooperate with the standard valve assembly 120 by opening the passageways of both valves by moving first valve member 128 away from first valve seat 126 to open outer passageway 152 and by moving second ball valve member 142 away from second valve seat 146 to open the interior passageway 154.

In operation, the Improved Coupler 10 is placed into valve assembly 120 such that the mating cams 62 and 64 on the probe 40 of the Improved Coupler 10 engage lugs 150 of the valve assembly 120. The lugs 150 fit through slots 66 and 68 and then the Improved Coupler 10 is rotated such that the mating cams 62 and 64 engage the lugs 150 and serve to retain the Improved Coupler 10 rigidly inside the valve assembly 120. During the process of this insertion, valve passageways 152 and 154 are opened and therefore the nature of the large flexible fluid seal 170 and the height of the large flexible fluid seal 170 relative to the probe head 100 and its tip 102 and relative to the small fluid seal 60 become very important. The height of the large flexible fluid seal 170 is such that it will come in contact with the upper surface of first valve housing 124 before the tip 102 of probe head 100 can come in contact with the upper surface of second ball valve member 142, and before the small fluid seal 60 can come in contact with the upper surface of the first valve member 128. The unique design of the large flexible fluid seal 170 is that it will come in contact with the upper surface of first valve housing 124 and seal off the area before the tip 102 of probe head 100 comes in contact with the second valve member 142 and moves it away from second valve seat 146. Were it not for this prior contact and sealing of the large flexible fluid seal 170, the liquid under pressure such as beer could spew out of the valve opening through inner passageway 154. While the container has not been pressurized by the Improved Coupler 10 as yet, some residual pressure inside the container could cause the liquid to spew out.

Figure 5:
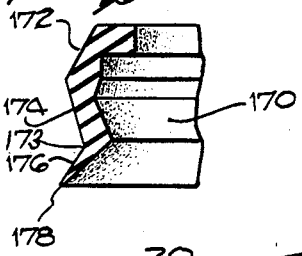
FIG. 5 is an enlarged partial side-sectional view showing the improved flexible seal to advantage.

The unique design of the large flexible fluid seal 170 as shown in FIG. 5 and FIG. 6 assures a firm seal as the valve assembly is opened by the probe head 100. When the tip area 178 of the large flexible fluid seal 170 comes in contact with the upper surface of first valve housing 124, the outward direction of the seal's lowermost portion 176 causes the large flexible fluid seal's lowermost portion 176 to spread outwardly as the seal is compressed against the upper surface of first valve housing 124, with the tip 178 extending to the outmost portion of the valve housing's upper surface. This assures that the entire upper surface area of the first valve housing 124 is sealed off and also assures that the entire area of the probe head 100 is sealed off.

As the Improved Coupler 10 is further pushed into the valve assembly 120, the tip 102 of the probe head 100 further pushes second ball member 142 away from second valve seat 146, further opening passageway 154. As the Improved Coupler 10 continues to be pushed down, the small fluid seal 60 comes in contact with the upper surface of first valve member 128 and pushes it away from first valve seat 126, thereby opening passageway 152. The small fluid seal 60 then serves to seal off passageway 154 while opening passageway 152, and further serves to seal one passageway from the next.

As this is taking place, the large flexible fluid seal 170 continues to be compressed further. The design of this seal permits it to fold in on itself in the area of inner recess 173 and this bellows action permits the lowermost portion 176 to be substantially flat against the upper surface of first valve housing 124. As a result, proper sealing of the valve area and probe head area is assured because the unique design of the seal assures that there is no chance that the compression of the seal will cause it to create an opening in the area of the valve and permit any leakage of beer (or other pressurized fluid) or gas. When the Improved Coupler 10 is firmly in place, the large flexible fluid seal 170 now acts as a gas seal, to firmly seal any elements such as gas or air which pass from the Improved Coupler 10 to passageway 152.

By way of example, if the height of the large flexible fluid seal is approximately 14 millimeters, the height of the probe head from its base taken at line 160 in FIG. 2 to its tip 102 can be approximately 12.5 millimeters. For reference purposes, the height of small fluid seal 60 can be 1.8 millimeters. The large flexible fluid seal 170 can be made of rubber and the small fluid seal 60 can also be made of rubber.

Therefore, the unique design of large flexible fluid seal 170 permits it to be used to seal liquid such as beer on the initial contact and later permits it to be used as a gas seal. This large flexible fluid seal 170 is what permits the utilization of a fixed probe head 100. The prior art coupling devices as illustrated in U.S. Pat. No. 4,181,143 could not work with a fixed probe head 100. The large outer seal illustrated in U.S. Pat. No. 4,181,143 does not have the flexible design which permits it to fold substantially flat against the valve assembly and fold back on itself as in the present invention. Further, it is much shorter relative to the fully extended head of the probe. Therefore, a seal as in U.S. Pat. No. 4,181,143 could only be used with a retractable or movable probe head such that the large outer seal is already in place and sealing off the valve area before a second mechanical step involving the actuation of the probe head and lowering it into contact with the ball valve member is possible. If the probe head in U.S. Pat. No. 4,181,143 were lowered and then the coupler were placed into the valve assembly the outer seal would not reach the surface of the valve housing in time to prevent any liquid from spewing out after the probe head was pushed the ball valve member away from its seat.

By having a system which accommodates the fixed probe head, the present invention substantially simplifies the installation process. All that need be done is to insert the Improved Coupler 10 into the valve assembly 120 as previously described and twist once to lock. The Improved Coupler 10 is then ready for operation. In systems which have a movable probe head, after the insertion and locking process, the coupler must be turned once again to actuate a mechanism which moves the probe head down or else the probe head is moved down by the complex mechanical actuating system described in U.S. Pat. No. 4,181,143. Either way, the movable probe head and its accompanying actuating mechanism allow for numerous areas of product failure if the coupler is subjected to rough handling in addition to adding to the cost of manufacture and assembly.

Another unique feature of the present invention is the one piece construction of the main cylinder body 12 and the fixed probe 40. By having the entire unit fabricated as a single piece, the cost of manufacture is also substantially reduced. The main cylinder body 12 and probe 40 can be made of plastic or of metal such as stainless steel, brass or aluminum. The cylinder cap 14 and the piston 22 can also be made of plastic or of stainless steel, brass or aluminum.

In operation, after the Improved Coupler 10 is inserted as described above, the piston 22 is depressed several times to generate a source of compressed air which is forced through the bores 48 and 50 and their check valve, and through bore 52 into the valve assembly. The compressed air flows through passageway 152 into the container 118. The check valve prevents the air (or $CO_2$) from coming out of the container. The large flexible fluid seal 170 acts as a gas seal at this point to assure that no air escapes. Initially, pressure from the container 118 keeps the check valve shut. When the piston 22 is depressed, air pressure overcomes the container pressure and air is pumped into the container 118. When the piston 22 is released, air comes into the main cylinder body 12 via slots 28. On the way down, the O-Ring 26 seals off the air. On the way up, the O-Ring moves down relative to the piston groove 24 and air is sucked into the main piston body 12 past the O-Ring 26 and the slots 28.

The compressed air flows into the container 118 through passageway 152 and the fluid is forced out through interior passagaway 154. As previously discussed, at this point in time, the small fluid seal 60 forms a barrier between the gas or air entering in outer passageway 152 and the fluid exiting through inner passageway 154.

Although the drawings and above text have referred to a consumer type coupler which is commonly called a picnic pump, the improved coupler described above is also applicable to a commercial type of coupler which has a source of gas pressure such as $CO_2$ which is forced through the check valve and into outer passageway 152. The piston 22 is merely replaced with a pressure receiving source. The design of the fixed probe head 100 and the large flexible fluid seal 170 are nearly the same.

After the fluid such as beer is forced through inner passageway 154, it enters primary fluid bore 56 and exits through fluid dispensing outlet 42.

Therefore, one key point of novelty of the present invention is the improved coupler 10 wherein the probe head 100 at the forward tip of the probe 40 is fixed and integral with the probe 40. Therefore, the improved coupler 10 can be inserted into the valve assembly 120 of the container 118 and the valve assembly 120 is simultaneously opened by one simple insertion and rotation movement of the improved coupler 10 so that the cams 62 and 64 on the probe 40 engage the lugs 150 on the valve assembly 120 and the probe head 100 simultaneously pushes the valve off its seat 146.

A second key point of novelty of the present invention is the large flexible fluid seal member 170, which is removable and placed on the outermost circumference of the forward end of the probe 40. The large flexible fluid seal 170 has three basic sections; an outwardly extending upper portion 172, an inwardly extending middle portion 174 and an outwardly extending lower portion 176, all integral and of one piece construction. This unique design incorporates a bellows action which permits the seal to fold in on itself between the upper portion 172 and middle portion 174, and permits the lower portion 176 to be substantially flat against the upper surface of the valve housing 124. Therefore, the large flexible fluid seal 170 will compress and seal within the space available. This unique design assures a firm seal at the interface of the probe 40 of the Improved Coupler 10 and the valve assembly 120 of the container 118 when the large flexible liquid seal 170 is compressed against the valve assembly 120 at the time the probe 40 of the Improved Coupler 10 is locked in place.

It is also a key point of novelty of the present invention that the large flexible fluid seal member 170 is of sufficient height so that it will come into contact with the valve assembly 120 before the probe head 100 opens the valve assembly 120. The seal is also removable so that it can be easily replaced if it becomes worn.

It is also a point of novelty of the present invention that the main cylinder body 12, the probe 40 and the probe head 100 are made of one piece construction.

The large flexible fluid seal member 170 can be made of flexible rubber material. The probe 40 and probe head 100 can be made of metal such as stainless steel, brass or aluminum or else they can be made of plastic or plastic derivatives. The main cylinder body 12 can also be made of plastic or plastic derivatives.

Of course, the present invention is not intended to be restricted to any particular form or arrangements, or any specific embodiment disclosed herein, or any specific use, since the same may be modified in various particulars or relations without departing from the spirit or scope of the claimed invention hereinabove shown and described of which the apparatus and methods shown are intended only for illustration and for disclosure of an operative embodiment and method of manufacture and not to show all of the various forms of modification in which the invention might be embodied or manufactured.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An improved coupler which is used to dispense fluid under pressure from a container by means of a probe at one end of the coupler which is inserted into a valve assembly at the opening of the container, wherein said valve assembly comprises dual valves which includes a first valve assembly and a second ball valve assembly, the first valve assembly comprising a first valve housing which has a first valve seat at its lower interior surface and a first valve member, the second ball valve assembly comprising a ball valve member which abuts the lower interior portion of the first valve member which acts as its valve seat, and a valve passageway associated with each of the valve assemblies which are opened when the valve members are moved away from the valve seats, wherein a probe head at the forward tip of the probe pushes the ball valve member away from its seat to open one passageway and a section of the probe head pushes first valve member away from the first valve seat to open the other passageway, so as to permit gas or air to be placed into the container and to permit fluid to exit the container through the opened passageways in the coupler, wherein the improvement comprises:

a. the probe head at the forward tip of the probe which being fixed and integral with the probe;

b. a large flexible bellows type fluid seal member placed on the outermost circumference of the foreward end of the probe;

c. said large flexible bellows type fluid seal member being of one piece construction and containing three sections, an outwardly extending upper portion, an inwardly extending middle portion and an outwardly extending lower portion; and d. said large flexible bellows type fluid seal member being of sufficient height so that the outwardly extending lower portion comes in contact with an upper surface of said first valve housing to thereby seal both of said valve passageways before the probe head comes in contact with said ball valve member and moves it away from its valve seat;

e. whereby said large bellows type fluid seal member will prevent any fluid from spewing out of the container after the probe head causes the entire valve assembly to open, and the flexibility of the three section design in the large bellows type fluid seal member creates a bellows action which permits the seal to fold in on itself between the upper portion and middle portion and permits the lower portion to be substantially flat against the upper surface of said first valve housing to thereby form a very secure sealing means.

2. The invention as defined in claim 1 wherein said large flexible bellows type fluid seal member is removable so that it can be easily replaced if it becomes worn.

3. The invention as defined in claim 1 wherein said improved coupler is used in conjunction with a source of $CO_2$ counterpressure.

4. The invention as defined in claim 1 wherein said improved coupler is used in conjunction with piston means which generates a source of air counterpressure.

* * * * *